US007156353B2

(12) United States Patent
Kringel et al.

(10) Patent No.: US 7,156,353 B2
(45) Date of Patent: Jan. 2, 2007

(54) PRODUCT DISPLAY DEVICE

(75) Inventors: George N. Kringel, Westport, CT (US); Frank Calderazzo, Englewood, FL (US); Robert S. Frichette, Trumbull, CT (US); Arthur A. Rotelli, III, Fairfield, CT (US)

(73) Assignee: News America Marketing Properties LLC, Chicago, IL (US)

( * ) Notice: Subject to any disclaimer, the term of this patent is extended or adjusted under 35 U.S.C. 154(b) by 69 days.

(21) Appl. No.: 10/627,181

(22) Filed: Jul. 25, 2003

(65) Prior Publication Data

US 2005/0017146 A1 Jan. 27, 2005

(51) Int. Cl.
*A47K 1/08* (2006.01)

(52) U.S. Cl. ..... 248/311.2; 248/103; 222/181.3; 215/399; 220/480

(58) Field of Classification Search ..... 248/313, 248/309.1, 311.2, 311.3, 312, 312.1, 499, 248/505, 103, 104, 105, 106, 102, 132, 551, 248/154; 222/181.3, 180, 181.2; 224/148.7, 224/148.6, 552, 567, 926
See application file for complete search history.

(56) References Cited

U.S. PATENT DOCUMENTS 583,521 A * 6/1897 Walsh ..... 206/201
1,295,120 A * 2/1919 Cartre ..... 232/41 E
1,547,014 A * 7/1925 Bantel ..... 248/313
1,549,155 A * 8/1925 Schwab et al. ..... 248/313
1,966,648 A * 7/1934 Ryberg ..... 222/183
2,539,935 A 1/1951 Stephens et al.
2,554,875 A * 5/1951 Okunami ..... 248/141
2,734,711 A * 2/1956 Shippen ..... 248/313
2,754,078 A * 7/1956 Koger et al. ..... 248/311.2
2,960,601 A * 11/1960 Higgins ..... 362/477
3,177,048 A * 4/1965 Whatley ..... 312/351
3,202,309 A * 8/1965 Simpson ..... 215/395
3,365,228 A * 1/1968 Hay ..... 294/31.2
3,429,542 A * 2/1969 Fagan ..... 248/313
4,071,976 A * 2/1978 Chernewski ..... 47/39
5,167,392 A * 12/1992 Henricksen ..... 248/311.2
5,240,125 A 8/1993 Kunz
5,289,652 A 3/1994 Kringel et al.
5,320,319 A * 6/1994 Winger et al. ..... 248/312.1
5,344,250 A 9/1994 Kringel et al.
D355,804 S 2/1995 Crivelli
5,472,289 A 12/1995 Kringel et al.
5,502,911 A 4/1996 Watts et al.
5,829,642 A 11/1998 Momboisse
5,944,238 A * 8/1999 Stark ..... 224/148.4
5,971,335 A 10/1999 Perrin et al.
6,109,599 A 8/2000 Kringel (Continued)

FOREIGN PATENT DOCUMENTS

WO WO 01/15576 A1 8/2000

*Primary Examiner*—A. Joseph Wujciak, III
(74) *Attorney, Agent, or Firm*—St. Onge Steward Johnston & Reens LLC

(57) ABSTRACT

An apparatus and method for displaying dispenser containers at point of sale locations. The device includes a drip tray or base for holding the product container and a back member that extends upwardly from the base. An adjustable loop is then looped around the product container, attached to the device and placed in tension to hold the product container firmly in the base and bias the product toward the back member. After placing the product container in the device, the device can then be used to display the product container for sampling or other purposes at a point of purchase location, including mounting the device to a store shelf.

30 Claims, 12 Drawing Sheets

U.S. PATENT DOCUMENTS 6,357,713 B1 3/2002 BeBow
6,612,057 B1 * 9/2003 Shoemaker et al. ..... 40/607.02
6,663,068 B1 * 12/2003 Huang ..... 248/311.2
6,820,770 B1 * 11/2004 Makino et al. ..... 222/180
2002/0008117 A1 1/2002 Strickler et al.
2004/0149765 A1 * 8/2004 Pryce ..... 220/737

* cited by examiner

PRODUCT DISPLAY DEVICE

FIELD OF THE INVENTION

With a device in accordance with the invention a product dispensing container can be firmly mounted to a store shelf so that customers can conveniently sample the contents of the dispensing container.

BACKGROUND OF THE INVENTION

The display of products at point of purchase locations is well known in the field of product marketing. The distribution of product samples is also well known in the field of product marketing. Display and distribution of product samples at point of sale locations to generate interest and thus sales in a product using special display devices has been known for many years in the field of product marketing.

For example, U.S. Pat. No. 5,502,911 issued to Watts et al. discloses a display device for an analgesic container mounted to a store shelf at a point of sale location. The container is attached to the display device and requires a special cap. Some products that are packaged to be sold in dispensing containers, such as perfume, are also displayed at point of purchase locations using special display devices. U.S. Pat. No. 5,829,642 issued to Momboisse discloses a display device for testing spray cosmetics. The device in Momboisse can be placed on a counter and the dispensing container holding the product to be sampled sits inside a case 13 out of view of the consumer.

Other holders for dispensing containers are also known in the prior art for general use. For example U.S. Pat. No. 6,357,713 issued to BeBow and U.S. Pat. No. 5,971,335 issued to Perrin et al. both disclose holders for dispensing containers. These holders require the dispenser containers to be held on an angle and each holder is limited to a specific size range of dispenser containers that will fit in each holder.

Connectors for attaching devices to store shelves are also known in the prior art. U.S. Pat. Nos. 6,109,599; 5,472,289; 5,344,250; and 5,289,652 issued to Kringel disclose various connectors and advertising display mounting devices for attaching to store shelves.

However, there exists a need for a product display device that permits the display of a product container, such as a dispensing container, at a point of sale location where the product container is visible to the consumer. Additionally, there is a need for a product display device that can be adjusted to accommodate different product containers having different sizes or dimensions especially a device that can be attached to a store shelf.

SUMMARY OF THE INVENTION

With a device in accordance with the invention a product dispensing container can be firmly mounted to store shelf so that customers can conveniently sample the contents of the dispensing container.

This is achieved in accordance with one embodiment of the invention with a device for displaying a product container with a base that defines an area for receiving the dispenser container. The base has at least one protuberance on the bottom wall of the base that partially defines a receiving area in the base. The protuberance can be of many dimensions. The protuberance has a lower base portion and an upper top portion with the protuberance base portion being closer to the back wall of the base than the protuberance's upper portion. Extending upwardly from the base of the invention is a back member. A generally flexible retaining member or loop is looped around or attached to the dispensing container and to an adjustable tensioner located at the back of the device.

When a dispensing container is positioned in the base and the flexible retaining member is placed in tension by the tensioner, the dispensing container is pressed downward against the protuberance in said base and is biased toward the back member so that the dispenser can be firmly held to a store shelf for customers to activate the dispenser and sample its contents.

In the preferred embodiment the device is made with a multi-piece back member including an adjustable tensioner, a hook and a slider arrangement that keeps the retaining member in tension. Another type of tensioner can be a screw around which one end of the retaining member is attached. Tension can be increased or adjusted by turning the screw in the appropriate direction. The retaining member can be a loop or a rigid element that couples at one end to a dispensing container and to the tensioner at another end.

The device can have its base removable from the rest of the device. This permits the base to act as a drip tray that can be changed if it becomes damaged, dirty or needs to be replaced for any other reason.

The back member can be made of multiple pieces such as a slider and back bracket arrangement with the slider having a hook to which the retaining member or loop is attached and a row of teeth, and the back bracket having a flexible tongue with a nub that engages the teeth of the slider. The flexible tongue of the back bracket engages teeth on the slider for adjusting the back bracket to accommodate containers of various sizes and maintain tension on the tensioning member.

The invention also contemplates having a connector that allows the display device to be attached to the front of a typical store shelf or at a point of sale location. The display device is particularly effective for use on store shelves to allow potential customers to sample product from a dispensing container such as a push top or pump dispenser used for hand lotion.

It is, therefore, an object of the invention to provide a display device for displaying a product dispensing container on a store shelf to enable customers to sample the contents of the container dispenser.

It is a further object of the invention to have a display device capable of displaying a product in a dispensing container that allows the product to be dispensed from the dispensing container while firmly holding the dispensing container while it is attached to a store shelf.

It is further an object of this invention to have a display device that holds the product in an upright position while it is attached to a store shelf.

It is a further object of the invention to have a product display device that can be attached to a store shelf that sufficiently supports a dispensing container to allow the dispenser to be operated while, at the same time, allowing the dispensing container to be positioned to stand out among other products on the shelf.

It is a further object of the invention to have a store shelf mounted product display device that includes apparatus to catch excess dispensed product that is spilled from the dispensing container when it is attached to a store shelf.

Because dispensing containers also come in a variety of sizes, it is also an object of some embodiments of the invention for the display device to be adjustable and capable of firmly holding a variety of container sizes while still permitting the dispenser contents to be dispensed when attached to a store shelf.

It is a further object of the invention to have a display device that will securely hold the product displayed and prevent its easy removal or theft from the point of sale location when attached to a store shelf.

It is yet another object of the invention to have a display device that permits the consumer to see the actual dispensing container for the product the consumer is dispensing and sampling when the dispensing container is attached to a shelf.

These and other objects and advantages of the invention can be understood from the following description of several embodiments of the invention as described in conjunction with the drawings.

DETAILED DESCRIPTION OF THE DRAWINGS

Figure 1:
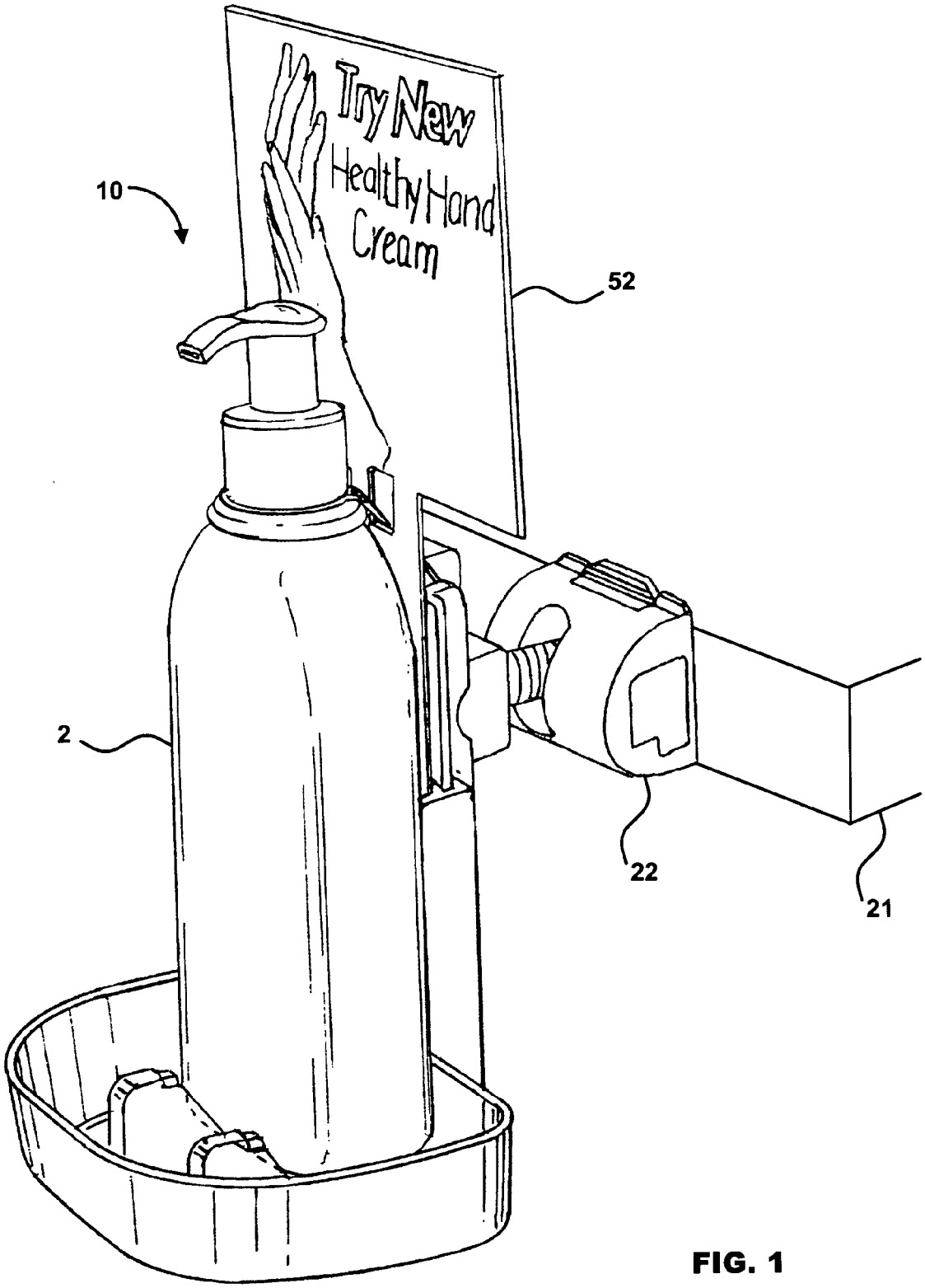
FIG. 1 is a perspective view of one embodiment of the invention.

A first embodiment of the invention can be seen in FIG. 1 which shows a perspective view of one embodiment of the invention fully assembled where the product container to be displayed in the product display device 10 is a dispensing container 2 with a push top dispenser. In FIG. 1, the product container is a dispenser for lotion such as hand lotion, but the device could be adapted for other containers or bottles, including those that contain other liquids, fluids or gels. The device could also be adapted for use with dispensers other than a push top or pump dispenser.

Figure 2:
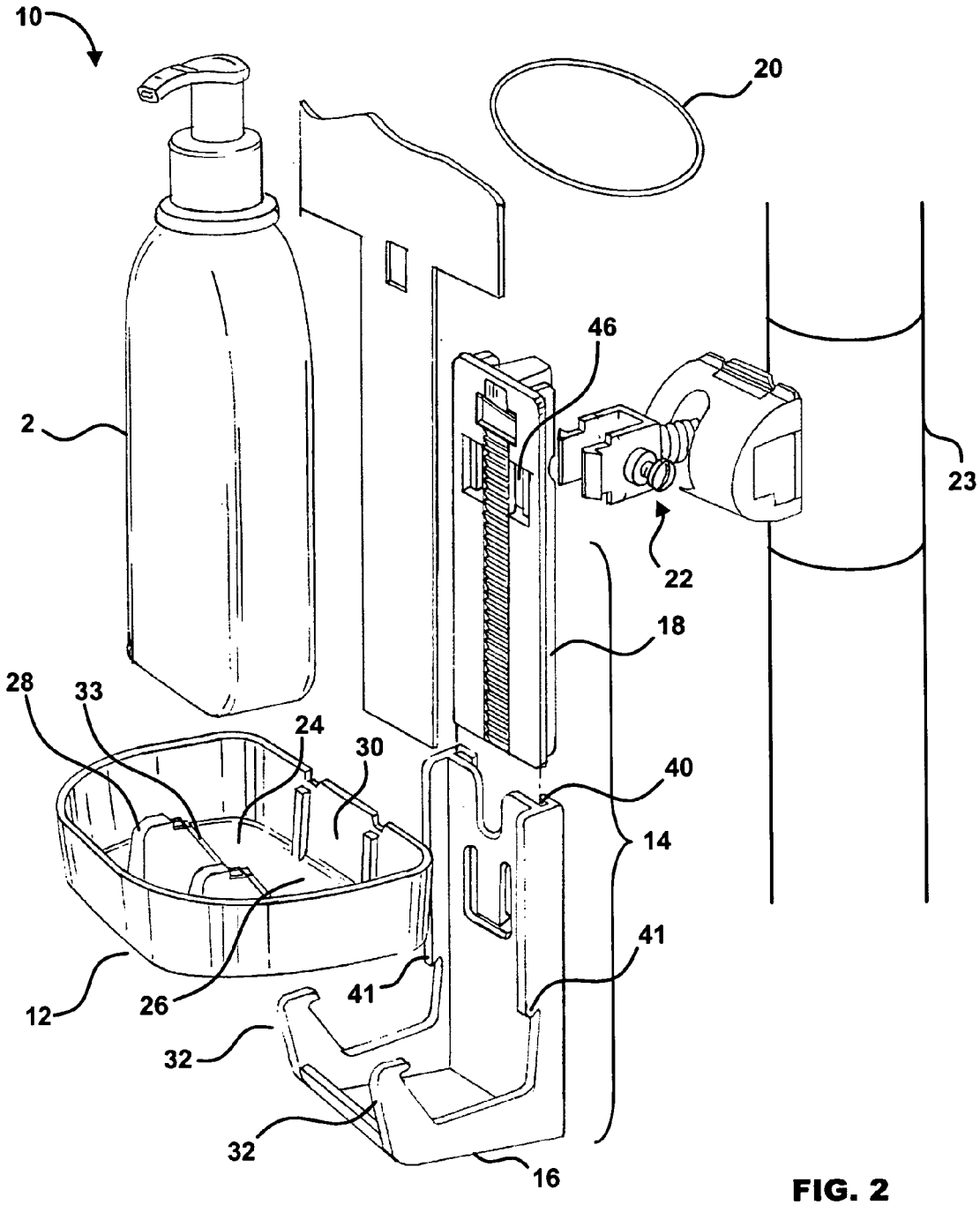
FIG. 2 is an exploded perspective view showing the components of the embodiment shown in FIG. 1

As better seen in the exploded view of FIG. 2, the product display device 10 includes a base or drip tray 12, and a back member 14 extending upwardly from the base 12. The back member in this first embodiment includes a back bracket 16 and a slider 18. In the preferred embodiment, the display device 10 also includes a generally flexible retaining member or loop 20 that is looped around the product container 2 near the upper end of the product container and the back member 14 when the device is fully assembled. In the preferred embodiment, the retaining member or loop 20 comprises a length of fishing line, but other flexible materials such as thread, plastic or rubber could be used. The retaining member could also be comprised of one or more rigid sections connected by articulating joints or hinges. The rigid retaining member acts as a rigid dispensing container gripper that grips the dispensing container near its upper end. The retaining member 20 need only be sufficiently movable or adjustable to permit the retaining member to be arranged to be joined between the dispensing product container and the device. The embodiment shown in FIG. 1 and FIG. 2 also includes a connector 22 that engages with the back member 14 and can be attached to a shelf 21 (as shown in FIG. 1) to hold the device 10 on the shelf 21. The connector in the preferred embodiment is used to attach the display device to a shelf 21 in a grocery store at a point of purchase location. A connector 22 can be used to attach the device not only to a store shelf but to any other type of support such as, but not limited to, stands, a poles 23 (as shown in FIG. 2), walls, ceilings, counters, doors or any other type of support found in the display area of a store. The device 10 without a connector could also be used on a store shelf or counter.

Figure 3:
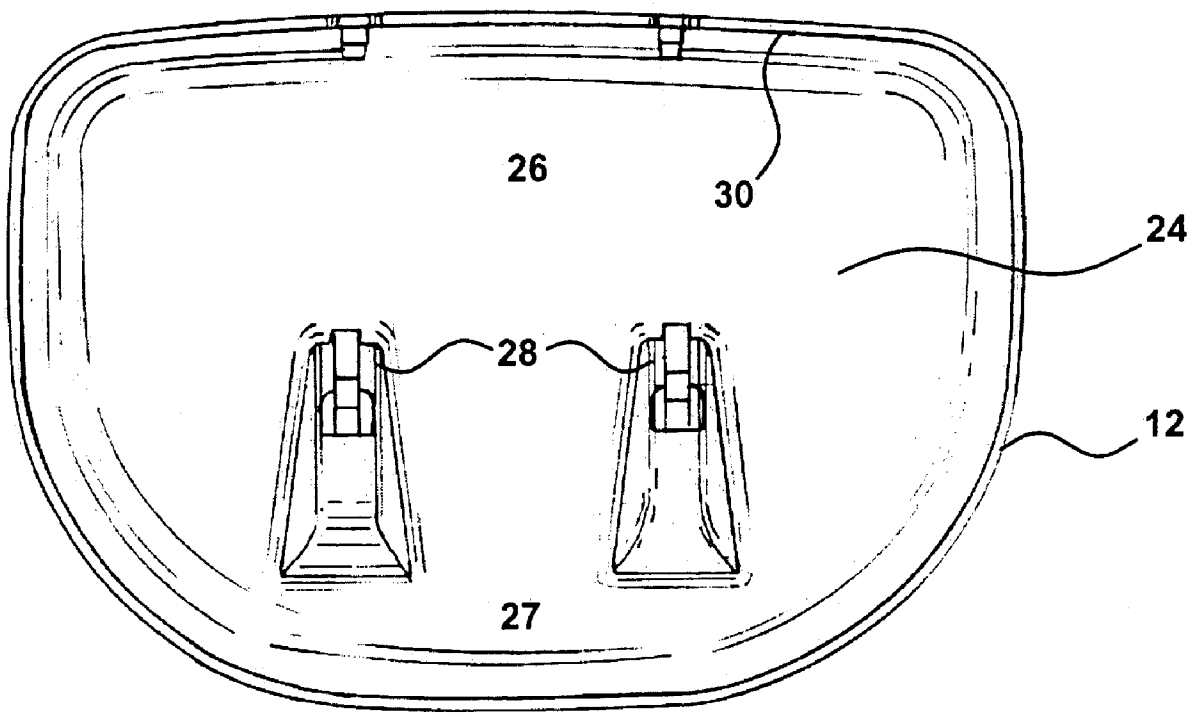
FIG. 3 is a top view of the base of the embodiment shown in FIG. 1
Figure 4:
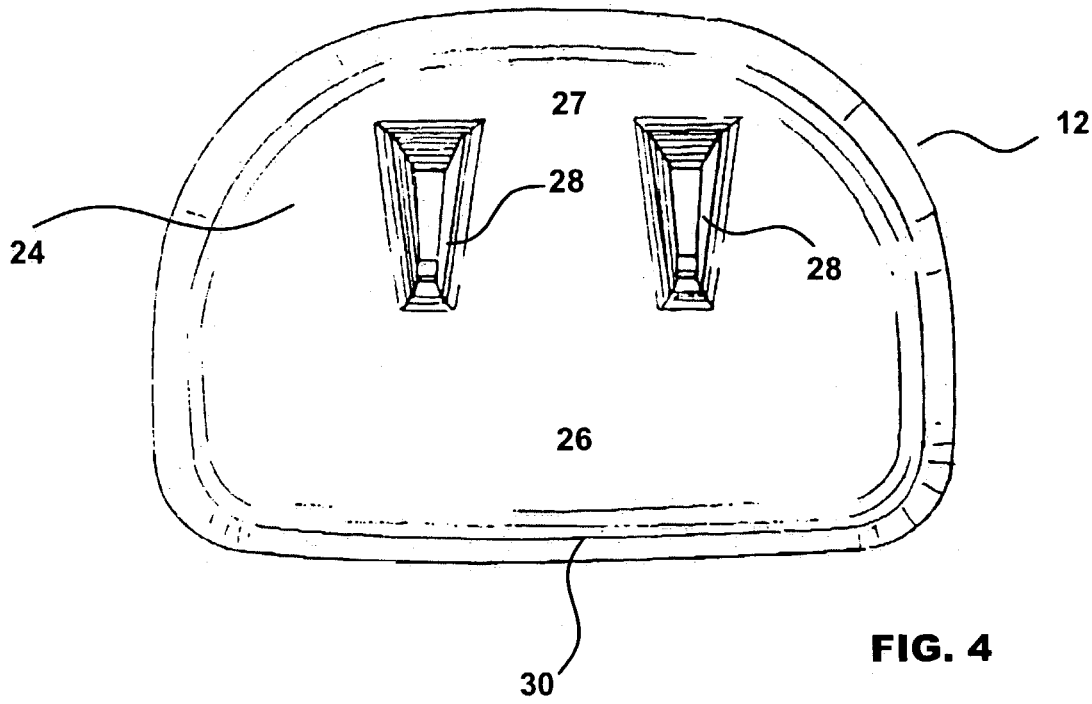
FIG. 4 is a bottom view of the base of the embodiment shown in FIG. 1.
Figure 4A:
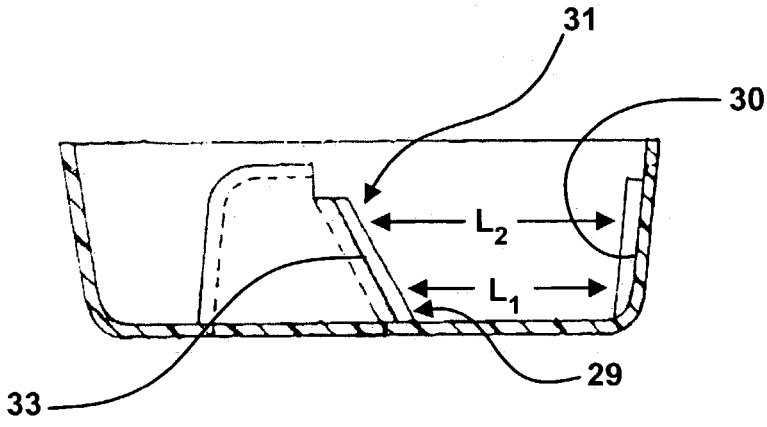
FIG. 4*a* is a cross-sectional, side view of the base of the embodiment shown in FIG. 1.

The base 12, which can also be seen in a top view in FIG. 3 and bottom view in FIG. 4, has a bottom wall 24 and a receiving area 26 for receiving the dispensing container 2. The base 2 also has at least one protuberance 28. In the embodiment shown in FIG. 3 and FIG. 4 the base has two protuberances or wings 28. It is known to those skilled in the art that various designs and shapes of protuberances can be used in the invention, provided that the distance between the lower portion or bottom 29 of the protuberance 28 and the back wall 30 of the base 12 is less than the distance between the upper portion or top 31 of the protuberance and the back wall 30 of the base 12. This can be best seen in FIG. 4A, a cross-section of the base in the first embodiment showing a protuberance 28. As shown in FIG. 4A, the distance $L_1$ (the distance between the lower portion of the protuberance or protuberance base 29 and the base's back wall 30) is less than the distance $L_2$ (the distance between the upper portion of the protuberance 31 and the base's back wall 30). In the embodiment shown in FIG. 1 and FIG. 2, each protuberance 28 has a straight, inclined surface 33 that slopes down toward the back wall 30 of the base. The protuberance 28 partially defines the receiving area 26 for the product container 2, such that when the product container 2 is placed in the receiving area 26, the product container is inhibited from moving within the base by the protuberances 28. Because the protuberance 28 is inclined, that is the lower portion of the protuberance 29 is closer to the back wall 30 than the upper portion of the protuberance 31, product containers with various dimensions can be used with the same base or drip tray 12 and still be held firmly in place when displaying the product container. This is particularly important when the product container 2 is a dispensing container and a potential customer activates the dispensing container to sample product from the dispensing container. The force created by activating the dispensing container can sometimes cause the product container to unintentionally and undesirably move or loosen within the base. Holding the base firmly is also important to prevent theft of the product container from the point of sale location. The base also extends out horizontally from the product container base to provide an area 27 for collecting drips from a product dispenser or any sampled product that is not properly handled by a consumer.

The base could also include a receiving area comprising a recessed area in the base having the approximate width and depth dimensions of the bottom portion of the dispensing container, thus allowing the bottom portion of the dispensing container to nest-within the recessed area.

Figure 6:
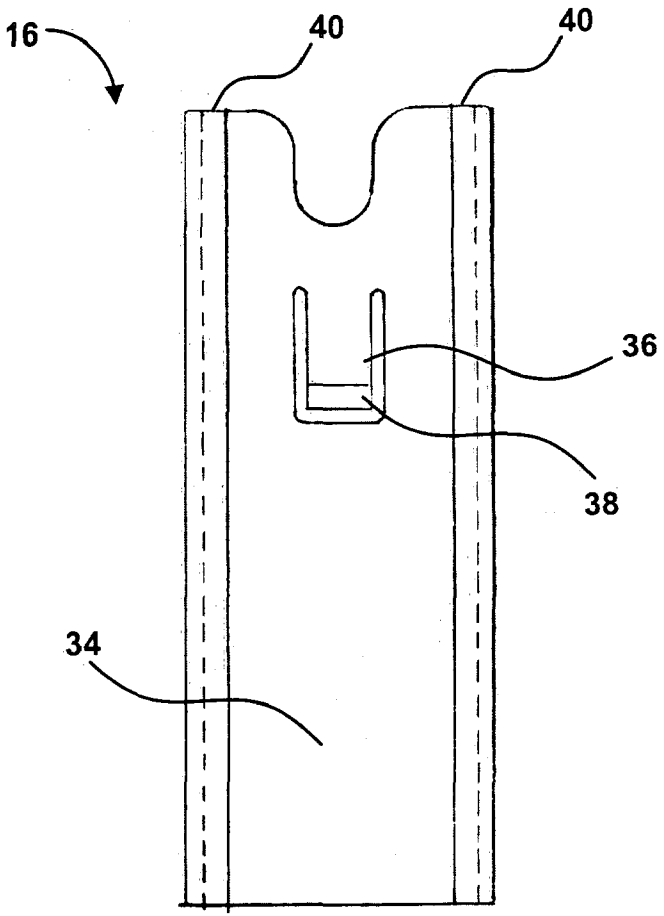
FIG. 6 is a back view of the back bracket of the embodiment shown in FIG. 1.
Figure 5:
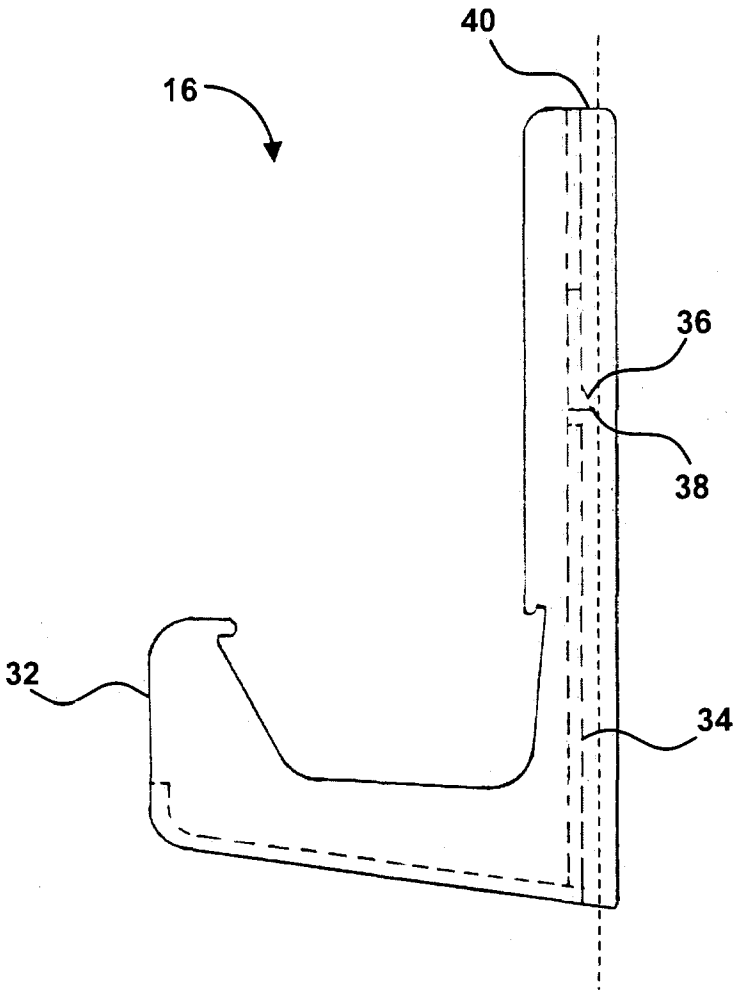
FIG. 5 is a side view of the back bracket of the embodiment shown in FIG. 1.
Figure 10:
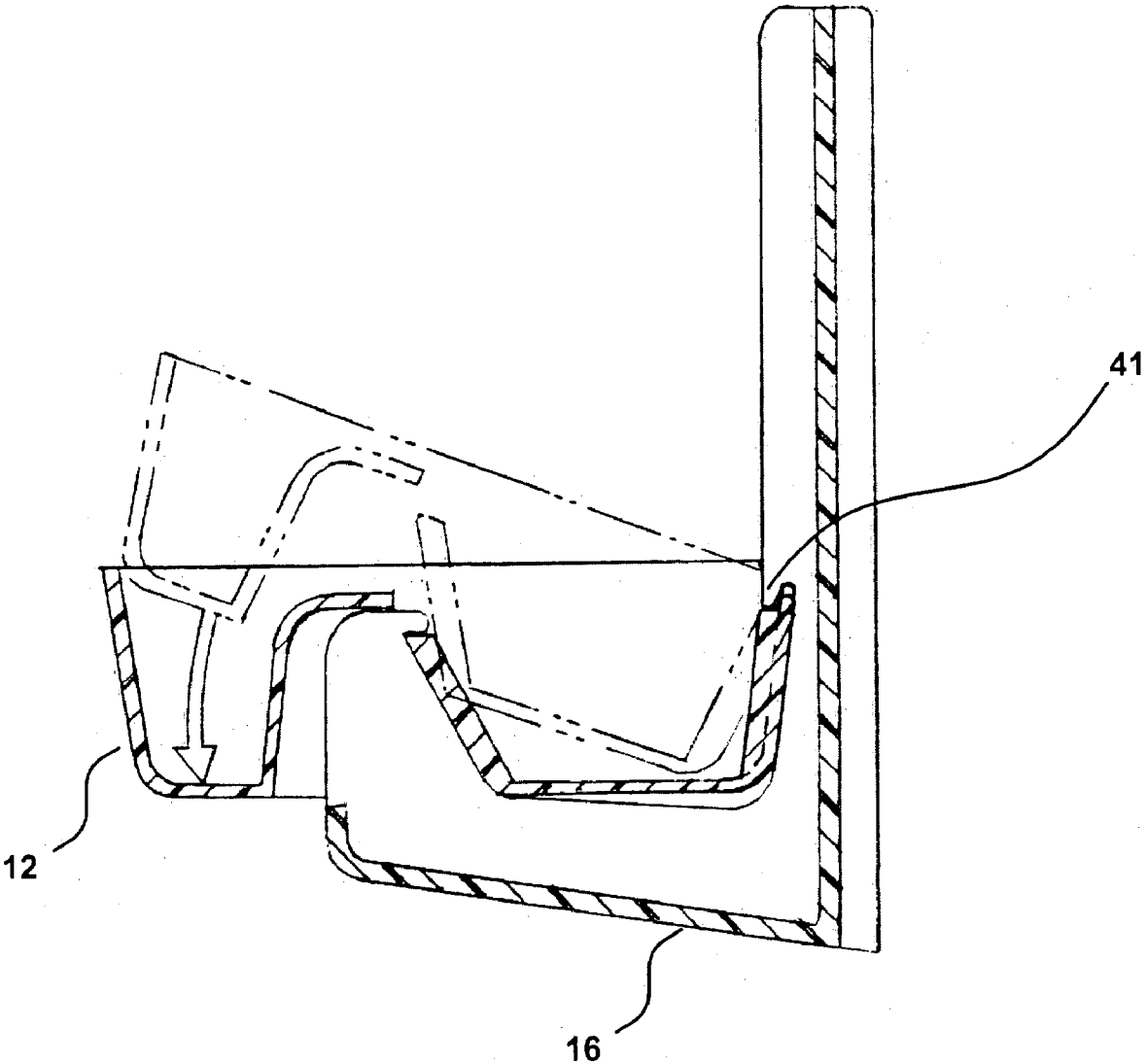
FIG. 10 is a side view showing the assembly of the base onto the back bracket of the embodiment shown in FIG. 1.

In the preferred embodiment, the base 2 is assembled onto the back bracket 16 shown in FIG. 5 and FIG. 6. The back bracket 16 has arms 32 that extend upward and fit into the protuberances 28 in the base. During assembly of the device, the base 12 can be easily assembled onto the back bracket 16 by first inserting the base's back wall 30 under a lip 41 then moving the base in the direction of the arrow shown in FIG. 10. This assembly of the base 12 permits easy assembly and replacement of the base during replacement of the base 12, due to cleaning, replacement or any other purpose. After the base 12 is assembled on the back bracket 16, the bottom of the product container 2 is positioned in the receiving area 26 of the base between the protuberance 28 and back wall 30. When in the base 12 and assembled with the retaining member in tension, the product container 2 is biased toward the back member 14. The product container 2 and retaining member can also be arranged to cause the product container to be biased in a downward direction toward the base 12, when the retaining member is in tension.

Figure 9:
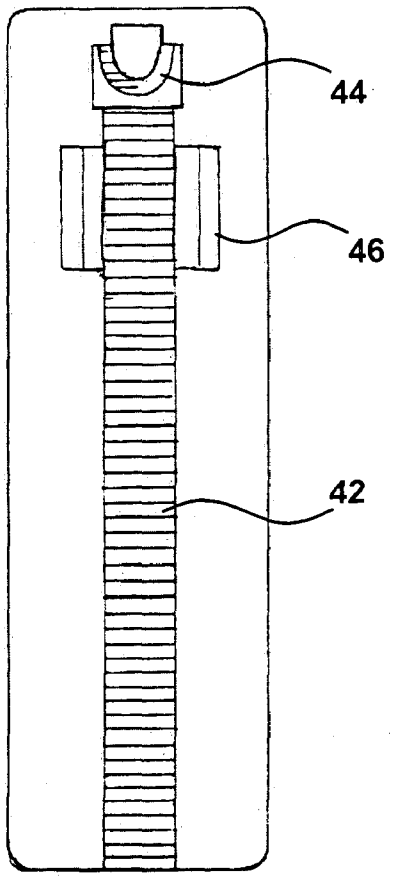
FIG. 9 is a front view of the slider of the embodiment shown in FIG. 1.
Figure 8:
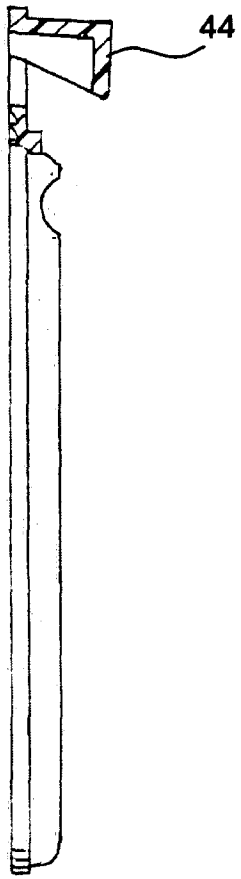
FIG. 8 is a cross-sectional view of the slider of the embodiment shown in FIG. 1.
Figure 7:
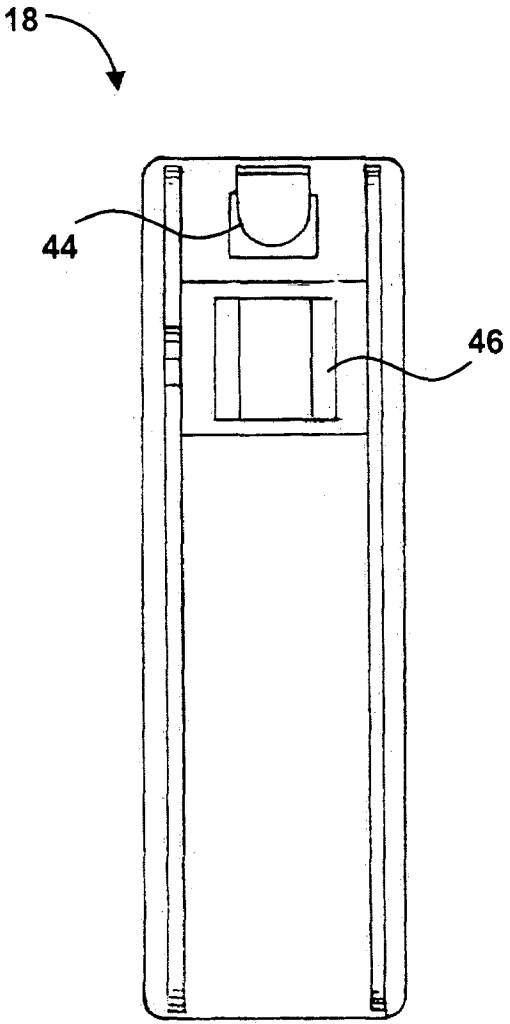
FIG. 7 is a back view of the slider of the embodiment shown in FIG. 1.

The back side 34 of the back bracket 16 has a flexible tongue 36 with a nub 38 at the end. This nub 38 is used to engage the slider 18 which is shown in detail in FIGS. 7, 8 and 9. The slider 18 has a series of stepped teeth 42 that extend down the front side of the slider 18. When the device is assembled, the slider 18 slides down in a channel 40 in the back bracket 16. As the slider slides down the channel 40, the teeth 42 on the slider shown in FIG. 9 begin to engage the tongue 36 and nub 38 of the back bracket. As the teeth 42 engage the tongue 36 and nub 38, the tongue 36 flexes to permit the slider 18 to continue to move downward; however, if the slider 18 is attempted to be moved upward in the opposite direction, the nub 38 locks in the teeth 42 and prevents the slider 18 from moving upward. The slider 18 also has a loop hook 44 around which loop 20 is looped. Other types of hooks or other fastening arrangements could also be used by those skilled in the art to fasten the loop 20 to the back member 14.

Figure 11:
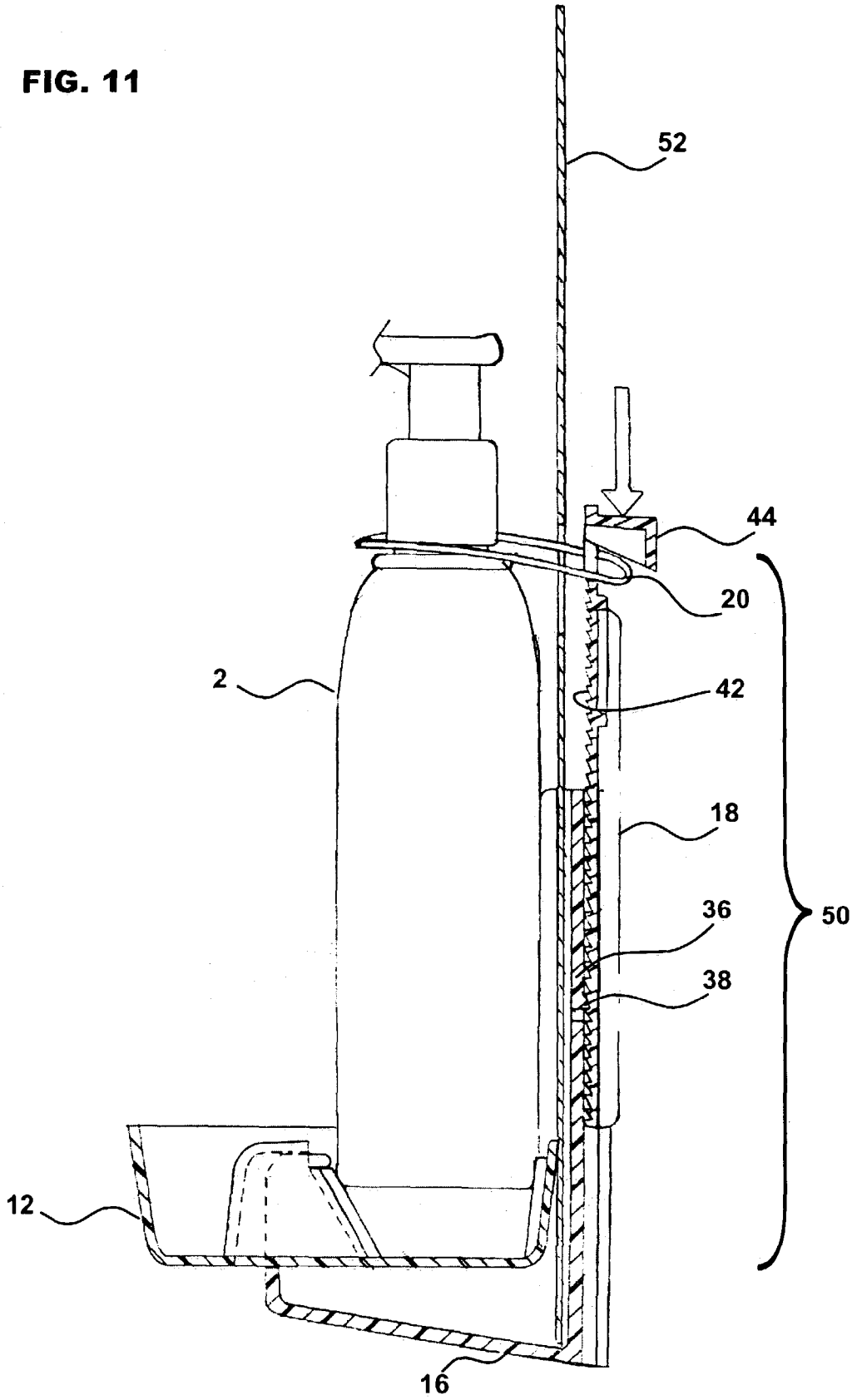
FIG. 11 is a cross-sectional view of the embodiment shown in FIG. 1 showing the assembly and tensioning of the retaining member looped on the dispenser bottle and slider.

The loop 20 is looped around the dispenser container 2, and around the loop hook 44. As shown by the arrow in FIG. 11, once the loop is looped around both the bottle 2 and loop hook 44, the slider 18 is moved downward. As the slider 18 moves downward in the back bracket channel 40, the tongue 36 flexes to allow the teeth 42 to slide past the tongue in a downward direction as shown by the arrow in FIG. 11; however, the nub 38 quickly engages with teeth 42 if the slider 18 is moved in an upward direction opposite the arrow. By having teeth 42 extending down the front of the slider 18, the slider 18, back bracket 16 and loop 20 form a tensioner 50 that is fully adjustable for a variety of product container sizes using the same size loop. The tensioner 50 can be slideably adjusted to ensure the correct amount of tension on the loop 20 to firmly hold the product container 2 in place without causing damage to the product container, regardless of the dimensions of the product container. When in tension, the retaining member 20 retains the dispensing container 2 in said base and biases the container 2 toward the back member 14. It is also contemplated that other arrangements could be used to tension the retaining member such as placing the teeth on the back bracket and flexible tongue on the slider, or various other types of known adjustable or ratchet assemblies could be used by those skilled in the art.

Figure 12:
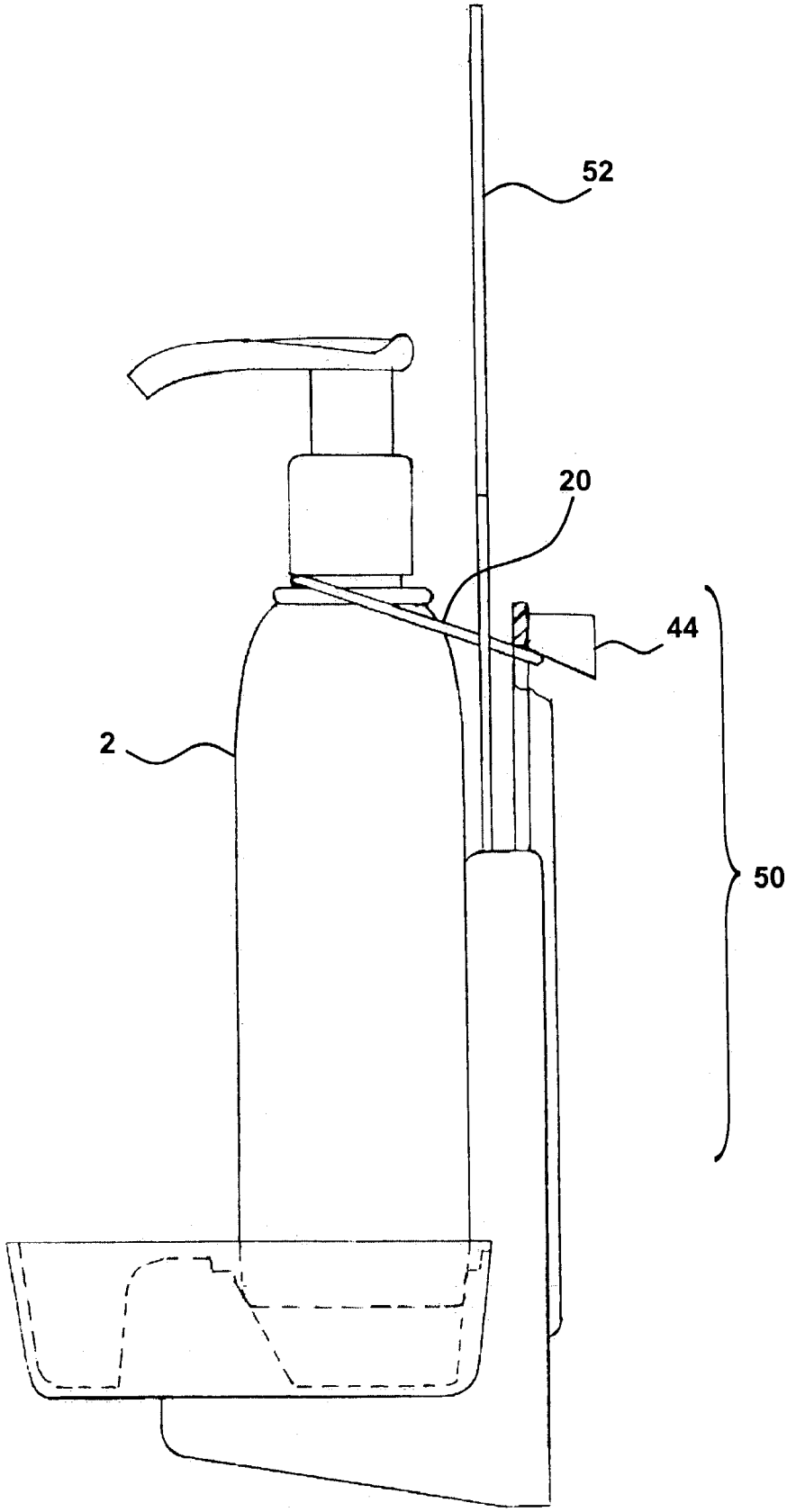
FIG. 12 is a side view of the embodiment shown in FIG. 1 showing the device in a fully assembled position.

By working together, the back bracket 16 with its flexible tongue 36 and the slider 18 with its teeth 42 and loop hook 44, act as a tensioner 50 that allows the user to exert tension on the retaining member 20 and maintain the tension on the retaining member 20 while the product container is displayed. FIG. 12 shows the embodiment in a fully assembled position with the tensioning element fully engaged. The back member 14 also has holes 46 that permit a connector 22 to attach to the back member 14. The connector 22 is then attached to-a-store shelf. Those skilled in the art will recognize that any variety of connectors could be used to attach the display device to a store shelf in a variety of ways, including, but not limited to, using any type of mechanical clamping, or locking, magnetism or adhesives. When attached to a shelf, such as a store shelf, this display device 10 holds the dispenser container 2 in a position extended from the shelf and in a substantially vertical position. The arrangement of the product container 2 in the device 10 permits the product container 2, from which the potential customer can dispense or sample product, to be displayed for easy viewing by the potential customer.

Figure 13:
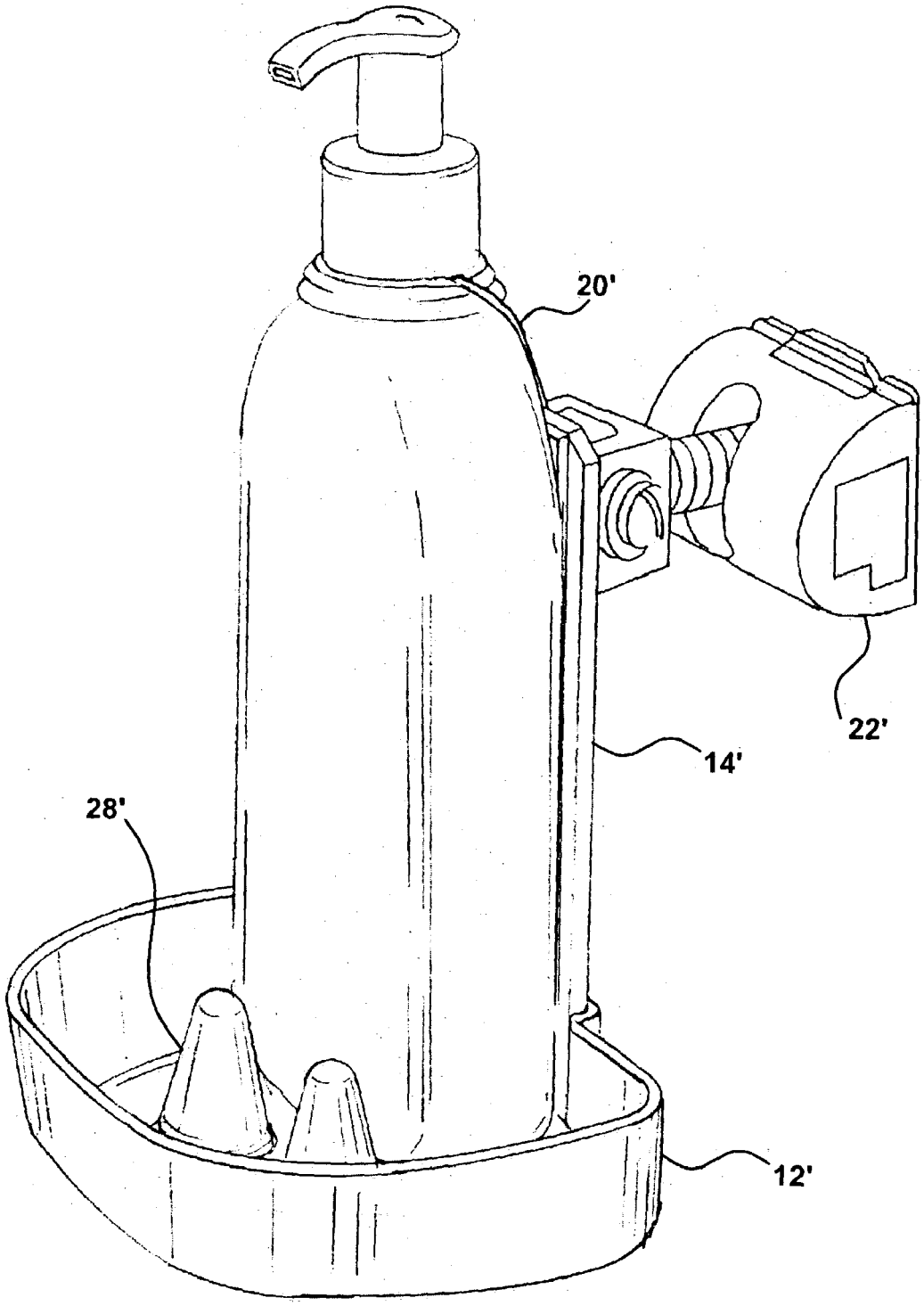
FIG. 13 is a perspective view of a second embodiment of the invention.
Figure 14:
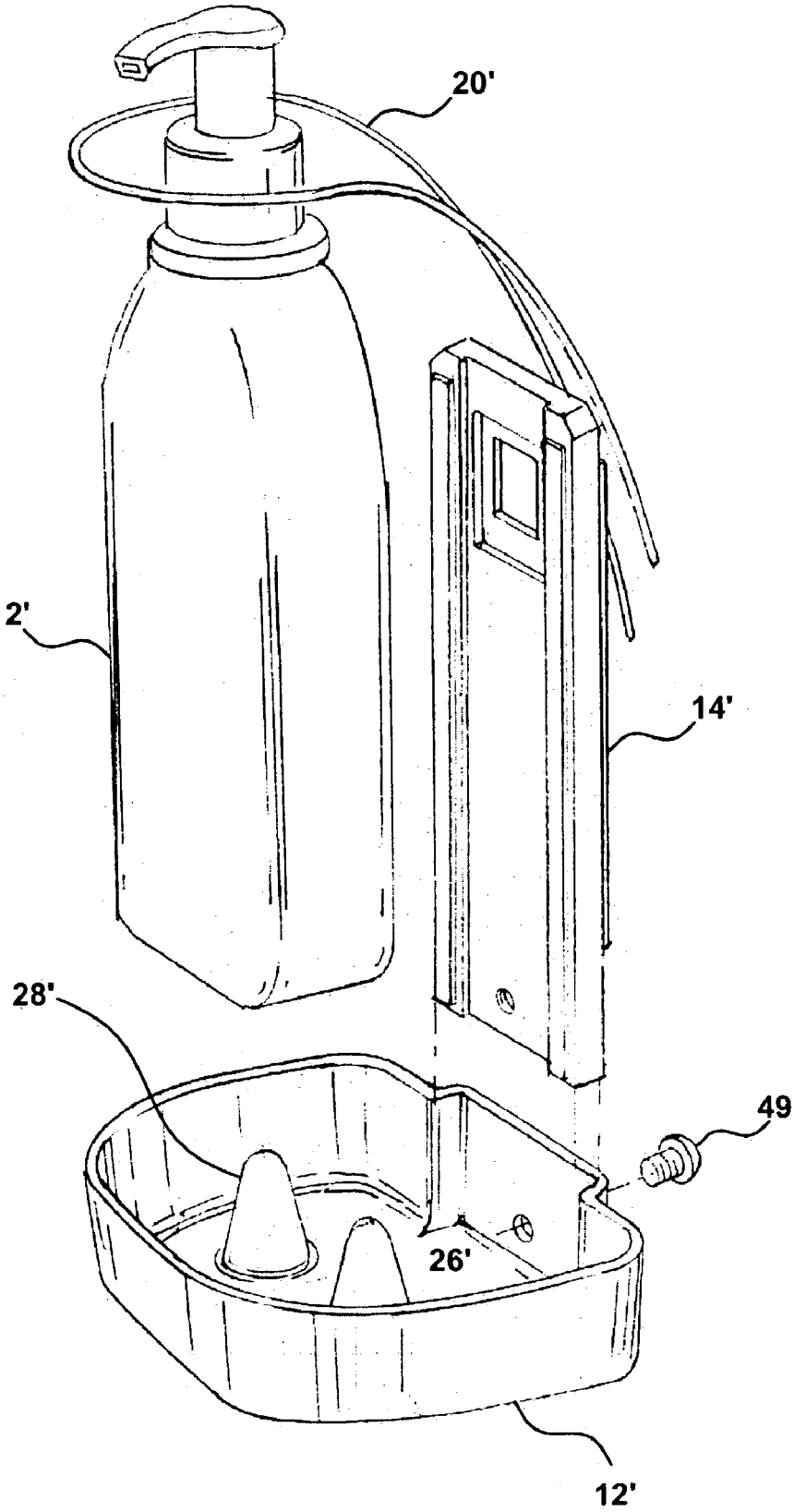
FIG. 14 is an exploded perspective view showing the components of the embodiment shown in FIG. 13.
Figure 15:
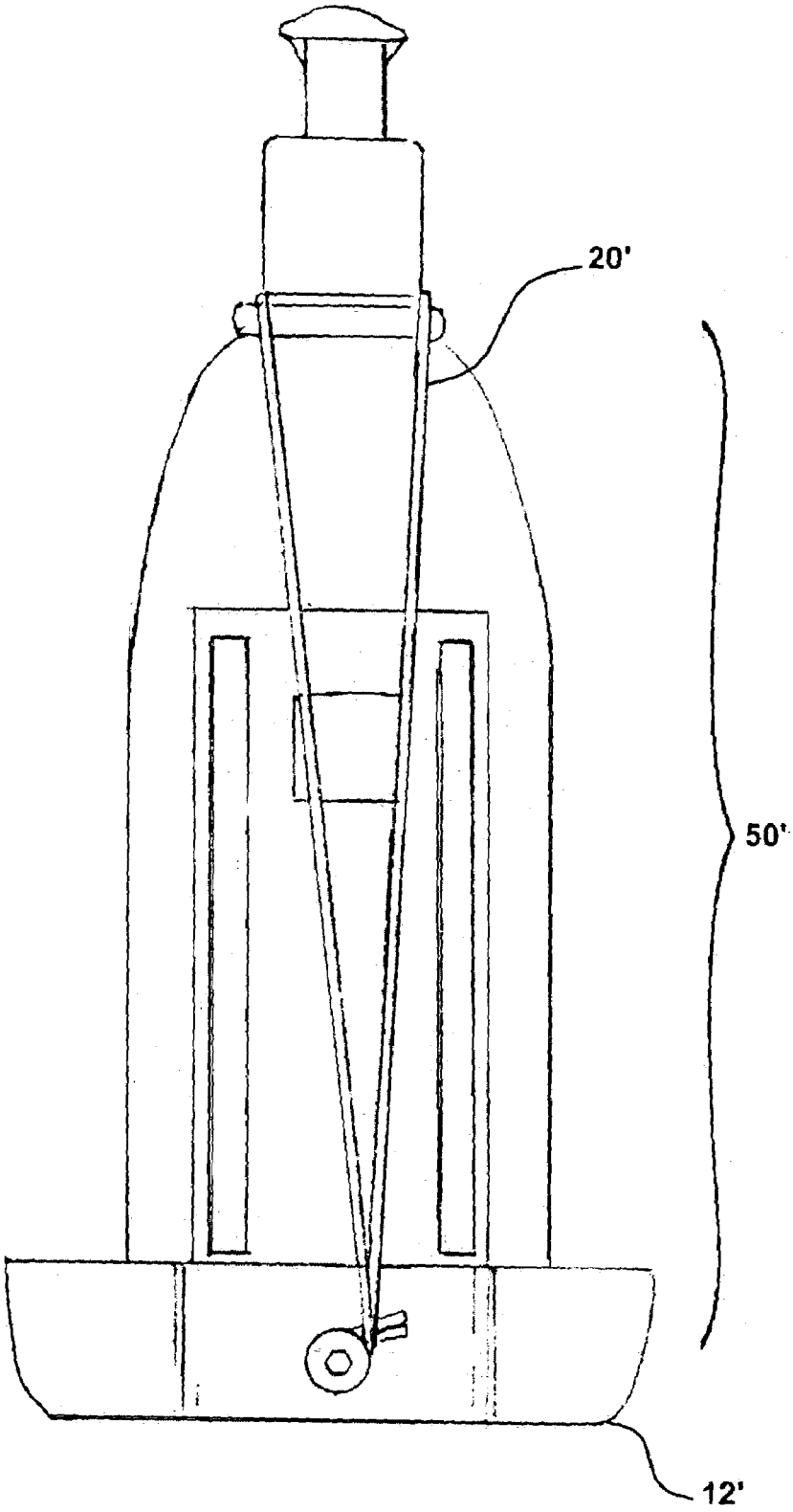
FIG. 15 is a back view of the embodiment shown in FIG. 13 showing the device in a fully assembled position.

A second embodiment of the device is shown in FIGS. 13, 14 and 15. Referring to FIG. 13, the second embodiment includes a base 12' with cone-shaped protuberances 28' for at least partially defining the product receiving area 26'. The back member 14' extends upwardly from the base 12'. The product container in the second embodiment also is a dispensing container 2' and is first placed in the base 12'. After the product container 2' is placed in the base 12', the flexible retaining member 20' is looped around the top end of the product container. The retaining member 20' is then extended down around the back member 14' and looped around a screw or fastener 49. When looped around the screw 49, the retaining member 20' is adjusted until the retaining member 20' is placed in sufficient tension to hold the product container 2 firmly in place. The product container 2' is then biased toward the back member 14'. The screw 49 can then be tightened to add further tension to the retaining member 20'. The combination of the retaining member 20' and screw 49 form a tensioner 50' that firmly holds the product container in place during operation of the dispenser container does not permit easy removal or theft of the product container.

The second embodiment can also be easily attached to a store shelf as a point of purchase display using a connector 22' as described earlier.

The product display device can also be arranged to incorporate or include printed marketing or advertising materials such as risers 52 which are slid down between the product container 2, 2' and the back member 14 14'. The back member 14, 14' can include slots or channels that permit the back member 14, 14' to receive and hold the riser 52. The riser 52 can also include openings through which the retaining member 20, 20' passes when the retaining member 20, 20' is assembled and tensioned on the device.

Having thus described several embodiments of a device to mount container dispensers onto a store shelf, its advantages can be appreciated. Variations of the invention can be made. For example, the flexible retaining member can be replaced a rigid bracket that at least partially engages a container dispenser and is coupled to the tensioner. When the tensioner is activated the rigid bracket is brought down on the dis-penser and its downward motion causes the dispenser to be pressed against the base and towards the back member.

What is claimed is:

1. A device for displaying a dispensing container comprising:

a base defining a receiving area adapted for receiving the dispensing container, said base having a bottom wall with a protuberance, said receiving area at least partially defined by said protuberance in said bottom wall;

a back member extending upwardly from said base;

a generally flexible retaining member adapted to be looped around a portion of the dispensing container and to be arranged such that when the dispensing container is disposed in said base and said retaining member is placed in tension the dispensing container is retained in said base and biased in a downward direction and toward said back member;

a tensioner to maintain said retaining member in tension when said retaining member is looped around a portion of the dispensing container, said tensioner comprising a loop, hook and slide arrangement; and wherein said hook retains the retaining member therein.

2. The device of claim 1 wherein said back member further comprises a slider and a back bracket, said slider and said back bracket being movable relative to each other to adjust the overall height of said back member.

3. The device of claim 1 wherein said base is removable from said back member.

4. The device of claim 1 wherein said base has a back wall and said protuberance has a lower portion and an upper portion with said lower portion being closer to said back wall than said upper portion, said back wall and said protuberance being adapted to receive the dispensing container between said back wall and said upper and lower portion to inhibit the dispensing container from moving in said base.

5. The device of claim 4 wherein said base has a second protuberance.

6. The device of claim 5 wherein said first and second protuberances each have a lower portion and an upper portion with said lower portions being closer to said back wall than said upper portions, said back wall and said protuberances being adapted to receive the dispensing container between said back wall and said upper and lower portions to inhibit the dispensing container from moving in said base.

7. A device adapted for displaying a product container from a support, said device comprising;

a base defining a receiving area adapted for receiving the product container;

a back member extending upwardly from said base;

a generally flexible retaining member adapted for looping around a portion of the product container and arranged such that when the product container is disposed in said base and said retaining member is placed in tension, the product container is retained in said base and biased in a downward direction and toward said back member;

a connector engaged with said back member and adapted to connect said back member to the support;

wherein said back member has a slider and a back bracket such that adjustment of said slider maintains said retaining member in tension when the product container is disposed in said base;

wherein said retaining member is a loop, and further having a tensioner comprising said loop and a hook attached to said slider, said loop being adapted for looping around the product container and said hook and said slider being adjustable relative to the product container for maintaining said retaining member in tension when looped around a product container; and wherein said slider comprises said hook for retaining the retaining member therein.

8. The device of claim 7 wherein said connector is adapted to connect said back member to a shelf.

9. The device of claim 7 wherein said connector is adapted to connect said back member to a pole.

10. The device of claim 7 wherein said base has a protuberance at least partially defining a receiving area for said product container.

11. A device for displaying a product container from a support, said device comprising:

a base defining a receiving area adapted for receiving the product container, said base having a bottom wall with a protuberance, said area for receiving the product container at least partially defined by said protuberance in said bottom wall;

a back member extending upwardly from said base, and being comprised of a slider and a back bracket;

a generally flexible retaining member adapted for looping around a portion of the product container and around a portion of the slider and arranged such that when the product container is disposed in said base and said slider and said back bracket are moved relative to each other the tension on said retaining member is adjusted;

a connector engaged with said back member and adapted to attach to the support;

wherein said slider comprises a hook for retaining said retaining member therein; and whereby the product container is biased in a downward direction toward the base and back member when said retaining member is in tension.

12. The device of claim 11 wherein said connector is adapted to attach said connector to a shelf.

13. The device of claim 11 such that the device is adapted to make at least a portion of the product container visible when displayed in said device.

14. The device of claim 11 further including marketing material positioned in said back member.

15. A method for displaying a product container from a support comprising:

providing a base defining an area for receiving the product container;

providing a back member extending upwardly from said base, said back member comprising a back bracket and slider movable relative to each other;

placing a product container in said base;

passing a retaining member around a portion of said product container and engaging said retaining member with said slider;

moving said back bracket and said slider relative to each other to adjust the tension in said retaining member and bias said product container in a downward direction and toward said back member;

attaching said back member to said support; and wherein said slider comprises a hook for retaining the retaining member therein.

16. The method of claim 15 further including assembling said base to said back member prior to placing said product container in said base.

17. The method of claim 15 wherein said back member is adapted to be attached to a shelf.

18. The method of claim 15 wherein said back member is adapted to be attached to a pole.

19. A device for displaying a dispensing container while being mounted to a support in a store, comprising:

a base defining a receiving area adapted for retaining a dispensing container;

a back member extending upwardly from said base;

an adjustable tensioner;

a retaining member adapted to be coupled to a dispensing container and to said tensioner to enable an adjustment of said tensioner to bias the dispensing container in a downward direction and against said back member, whereby the dispensing container can be firmly held in place to a support while being accessible to customers for examining the contents of the dispensing container;

wherein said tensioner comprises a slider and a back bracket moveable relative to each other for tensioning of said retaining member during adjustment of said tensioner; and wherein the slider comprises a hook for retaining said retaining member therein.

20. The device of claim 19 wherein said device is adapted to be attached to a store shelf.

21. The device of claim 19 and further comprising:

said base having a protuberance adapted to contact a lower end of a dispensing container.

22. The device of claim 19 wherein said retaining member comprises one or more rigid sections.

23. The device of claim 19 wherein said retaining member comprises a flexible loop.

24. A device for displaying a dispensing container from a store shelf comprising;

a base for supporting the dispensing container;

a back member extending upwardly from said base said back member further comprises a slider and a back bracket movable relative to each other;

a retaining member adapted to surround a portion of the dispensing container and engaging said slider wherein the tension on said retaining member is adjusted by the relative movement between said slider and said back bracket;

said retaining member adapted to cause the dispensing container to be biased in a direction downward and against said back member;

a connector adapted for connecting said device to the store shelf; and wherein said slider comprises a hook for retaining said retaining member therein.

25. A device for displaying a dispensing container from a support in a store comprising:

a base defining a receiving area adapted for receiving the dispensing container;

a back member extending upwardly from said base, said back member further comprises a slider and a back bracket, said slider and said back bracket being movable relative to each other to adjust the overall height of said back member;

an adjustable retaining member adapted to be positioned around a portion of the dispensing container and connected to said back member such that said retaining member retains the dispensing container in a substantially upright position in said receiving area and the dispensing container is biased downward and toward said back member;

a tensioner comprised of said slider, said back bracket, said retaining member and a hook on said slider for adjusting the tension on said retaining member;

a connector adapted for connecting said device to the support; and wherein said hook retains the retaining member therein.

26. The device of claim 25 wherein said connector is adapted to be connected to a store shelf.

27. The device of claim 25 wherein said connector is adapted to be connected to a pole.

28. The device of claim 25 wherein said base further comprises a protuberance, said protuberance being adapted to receive a dispensing container in said base.

29. A device adapted for displaying a product container from a support, said device comprising;

a base defining a receiving area adapted for receiving the product container;

a back member extending upwardly from said base, the back member having a slider and back bracket being movable relative to each other;

a generally flexible retaining member adapted for looping around a portion of the product container and for connecting to said slider, and said flexible retaining member being arranged such that when the product container is disposed in said base and said back bracket and slider are moved relative to each other, the tension in said retaining member is adjusted, whereby the product container is biased in a downward direction toward the base and back member when said retaining member is in tension; and wherein said slider comprises a hook for retaining said retaining member therein.

30. A device adapted for displaying a product container from a support, said device comprising;

a base defining a receiving area adapted for receiving the product container;

a back member extending upwardly from said base, the back member having a slider and back bracket being movable relative to each other;

a generally flexible retaining member adapted for looping around a portion of the product container and for connecting to a hook on said slider; and a tensioner comprised of said slider, back bracket, retaining member and hook for adjusting the tension on the retaining member.

* * * * *